US006408052B1

(12) United States Patent
McGeoch

(10) Patent No.: US 6,408,052 B1
(45) Date of Patent: Jun. 18, 2002

(54) Z-PINCH PLASMA X-RAY SOURCE USING SURFACE DISCHARGE PREIONIZATION

(76) Inventor: Malcolm W. McGeoch, 20 Chapel St., C512, Brookline, MA (US) 02446

( * ) Notice: Subject to any disclaimer, the term of this patent is extended or adjusted under 35 U.S.C. 154(b) by 0 days.

(21) Appl. No.: 09/543,495

(22) Filed: Apr. 6, 2000

(51) Int. Cl.[7] ..... H01J 35/00
(52) U.S. Cl. ..... 378/119; 378/122
(58) Field of Search ..... 378/119, 121, 378/34, 122

(56) References Cited

U.S. PATENT DOCUMENTS

| | | | | | |
|---|---|---|---|---|---|
| 4,538,291 | A | * | 8/1985 | Iwamatsu | 378/119 |
| 4,627,086 | A | * | 12/1986 | Kato et al. | 378/119 |
| 4,715,054 | A | * | 12/1987 | Kato et al. | 378/122 |
| 4,752,946 | A | * | 6/1988 | Gupta et al. | 378/119 |
| 4,771,447 | A | * | 9/1988 | Saitoh et al. | 378/119 |
| 4,837,794 | A | * | 6/1989 | Riordan et al. | 378/119 |
| 4,841,556 | A | * | 6/1989 | Kato et al. | 378/119 |
| 5,134,641 | A | | 7/1992 | Friede et al. | |
| 5,142,166 | A | | 8/1992 | Birx | |
| 5,243,638 | A | * | 9/1993 | Wang et al. | 378/119 |
| 5,315,629 | A | | 5/1994 | Jewell et al. | |
| 5,504,795 | A | | 4/1996 | McGeoch | |
| 5,763,930 | A | | 6/1998 | Partlo | |

OTHER PUBLICATIONS

Soviet Physics Journal, "A Generator of Large Current Pulses of Short Duration" vol. 11, No. 1, pp. 145–147, 1968.
J. Applied Physics "Plasma–Assisted Electron Emission from (Pb, La)(Zr, Ti)O3 Ceramic Cathodes" pp. 3669–3674, Apr. 1, 1996.
Malcolm McGeoch "Radio Frequency Preionized Xenon Z–Punch source for Extreme Ultraviolet Lithography". Applied Optics, Mar. 20, 1997, vol. 37, No. 9.

* cited by examiner

*Primary Examiner*—Robert H. Kim
*Assistant Examiner*—Irakli Kiknadze
(74) *Attorney, Agent, or Firm*—Wolf, Greenfield & Sacks, P.C.

(57) ABSTRACT

A Z-pinch plasma X-ray source includes a chamber having an insulating wall and defining a pinch region, a pinch anode and a pinch cathode positioned at opposite ends of the pinch region, a first conductor defining an edge in close proximity to or contacting an inside surface of the insulating wall and a second conductor disposed around an outside surface of the insulating wall. A surface discharge is produced on the inside surface of the insulating wall in response to application of a voltage to the first and second conductors. The surface discharge causes the gas to ionize and to form a plasma shell near the inside surface of the insulating wall. The pinch anode and the pinch cathode produce a current through the plasma shell in an axial direction and produce an azimuthal magnetic field in the pinch region in response to application of a high energy electric pulse to the pinch anode and the pinch cathode. The azimuthal magnetic field causes the plasma shell to collapse to the central axis and to generate X-rays.

42 Claims, 7 Drawing Sheets

Z-PINCH PLASMA X-RAY SOURCE USING SURFACE DISCHARGE PREIONIZATION

FIELD OF THE INVENTION

This invention relates to plasma X-ray sources of the Z-pinch type and, more particularly, to plasma X-ray sources that utilize a surface discharge to initiate a plasma discharge at relatively low gas pressures.

BACKGROUND OF THE INVENTION

A Z-pinch plasma X-ray source that utilizes the collapse of a precisely controlled low density plasma shell to produce intense pulses of soft X-rays or extreme ultraviolet radiation is disclosed in U.S. Pat. No. 5,504,795 issued Apr. 2, 1996 to McGeoch. The X-ray source includes a chamber defining a pinch region having a central axis, an RF electrode disposed around the pinch region for preionizing the gas in the pinch region to form a plasma shell that is symmetrical around the central axis in response to application of RF energy to the RF electrode, and a pinch anode and a pinch cathode disposed at opposite ends of the pinch region. An X-radiating gas is introduced into the chamber at a typical pressure level between 0.1 torr and 10 torr. The pinch anode and the pinch cathode produce a current through the plasma shell in an axial direction and produce an azimuthal magnetic field in the pinch region in response to application of a high energy electrical pulse to the pinch anode and the pinch cathode. The azimuthal magnetic field causes the plasma shell to collapse to the central axis and to generate X-rays.

While the disclosed X-ray source is very effective for pinch plasmas driven by upwards of 100 joules (J) of stored energy, the requirement for use as a source in scanning ring field cameras in the process of extreme ultraviolet lithography is for repetition frequencies in excess of 1 kilohertz at lesser stored energy. In this application, it may be desirable for stored energies much less than 100 J to be used, with a preferred range between 10 and 100 J for the Z-pinch X-ray source. With such low applied energies, a proportionately lower initial gas density is required in order to reach the same plasma temperature and to radiate in the extreme ultraviolet bands of interest. The reduced gas density, however, increases the difficulty of ignition of the pinch discharge, because the electron mean free path is comparable to the dimensions of the pinch chamber. Such conditions involve the density regime on the lower side of the so-called "Paschen minimum" in the plot of gas breakdown voltage as a function of the product of gas density times the characteristic dimension of the apparatus, where rapidly increasing voltage is required to break the gas down in order to carry a high current discharge.

In this circumstance, it is found that radio frequency preionization is less effective for two reasons. Because of electron losses on the walls of the chamber, there is an increasing probability that the preionizer discharge fails to ignite before the main current pulse is applied. Also, the radio frequency discharge becomes more diffuse, extending almost uniformly throughout the cylindrical pinch chamber, and is incapable of reliably initiating the main pinch discharge near the chamber walls, as can be achieved at higher gas density.

Accordingly, there is a need for improved preionization techniques in Z-pinch plasma X-ray sources which operate at low gas densities.

SUMMARY OF THE INVENTION

According to a first aspect of the invention, a Z-pinch plasma X-ray source is provided. The plasma X-ray source comprises a chamber containing a gas at a prescribed pressure, the chamber comprising an insulating wall and defining a pinch region having a central axis, a pinch anode disposed at one end of the pinch region, a conductive shell surrounding the insulating wall and electrically connected to the pinch anode, and a pinch cathode disposed at the opposite end of the pinch region. The plasma X-ray source further comprises a first conductor defining an edge in close proximity to or contacting an inside surface of the insulating wall, and a second conductor disposed around an outside surface of the insulating wall, wherein a surface discharge is produced on the inside surface of the insulating wall in response to application of a voltage to the first and second conductors. The surface discharge causes the gas to ionize and to form a plasma shell near the inside surface of the insulating wall. The pinch anode and the pinch cathode produce a current through the plasma shell in an axial direction and produce an azimuthal magnetic field in the pinch region in response to an application of a high energy electrical pulse to the pinch anode and the pinch cathode. The azimuthal magnetic field causes the plasma shell to collapse to the central axis and to generate X-rays.

In a first embodiment, the first conductor is coupled between the cathode and the insulating wall. In a second embodiment, the first conductor comprises the cathode, and the cathode is tapered toward the insulating wall to define the edge. In either case, the surface discharge is initiated at the edge of the first conductor and propagates along the inside surface of the insulating wall toward the pinch anode. In a third embodiment, the second conductor comprises the conductive shell that surrounds the insulating wall. In this embodiment, the surface discharge is initiated upon application of the high energy electrical pulse to the pinch anode and the pinch cathode.

In a fourth embodiment, the second conductor comprises a preionizer control electrode positioned between the conductive shell and the insulating wall. The preionizer control electrode is coupled to a preionizer voltage source which, for example, may be a radio frequency source. In this embodiment, the preionizer voltage may be applied to the preionizer control electrode prior to application of the high energy pulse to the pinch anode and the pinch cathode. In the fourth embodiment, the preionizer control electrode may comprise a single element or a plurality of elements having separate voltages applied thereto.

In one embodiment, the gas utilized in the Z-pinch chamber may comprise xenon for the generation of extreme ultraviolet radiation in a band between 100 angstroms and 150 angstroms. In another embodiment, the gas may comprise lithium for the generation of the doubly ionized lithium resonance line at 135 angstroms. A carrier gas may be utilized to deliver and remove lithium vapor.

According to another aspect of the invention, a Z-pinch plasma X-ray system comprises a plasma X-ray source as described above, a gas supply system coupled to the chamber of the plasma X-ray source and a drive circuit connected to the pinch anode and the pinch cathode for applying the high energy electrical pulse to the pinch anode and the pinch cathode. In one embodiment, the drive circuit comprises a solid state switched pulse generator with magnetic pulse compression.

The gas supply system may comprise a vacuum pump coupled to the pinch region for recompression of exhaust gas pumped from the pinch region and for recirculating the gas to the pinch region. The gas supply system may further comprise a filter module for filtration and purification of the gas exhausted from the pinch region prior to its return to the pinch region.

The plasma X-ray system may further comprise a barrier plate located on the axis outside the pinch region. The barrier plate has a multiplicity of aligned holes for passing soft X-rays or extreme ultraviolet radiation, while impeding the flow of gas from the pinch region.

According to a further aspect of the invention, a method is provided for generating soft X-rays or extreme ultraviolet radiation in a Z-pinch plasma X-ray source comprising a Z-pinch chamber containing a gas at a prescribed pressure, a chamber comprising an insulating all and defining a pinch region having a central axis, a pinch anode disposed at one end of the pinch region and a pinch cathode disposed at an opposite end of the pinch region. The method comprises the steps of producing on an inside surface of the insulating wall a surface discharge that causes the gas to ionize and to form a plasma shell near the insulating wall, and applying a high energy electrical pulse to the pinch anode and the pinch cathode to produce a current through the plasma shell in an axial direction and to produce an azimuthal magnetic field in the pinch region. The azimuthal magnetic field causes the plasma shell to collapse to the central axis and to generate X-rays.

BRIEF DESCRIPTION OF THE DRAWINGS

For a better understanding of the present invention, reference is made to accompanying drawings, which are incorporated herein by reference and in which.

DETAILED DESCRIPTION

Figure 1:
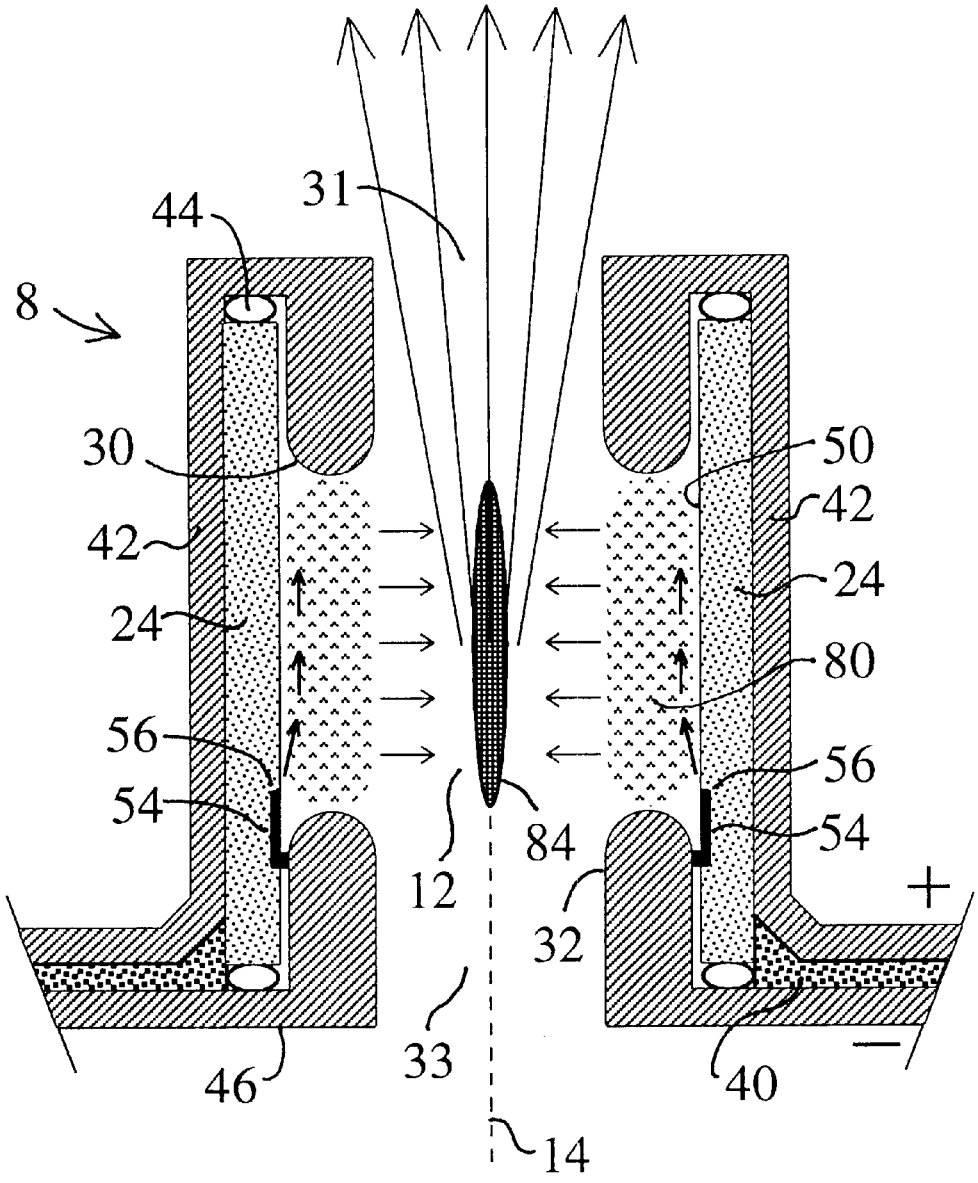
FIG. 1 is a cross-sectional view of a plasma X-ray source in accordance with a first embodiment of the invention.
Figure 6:
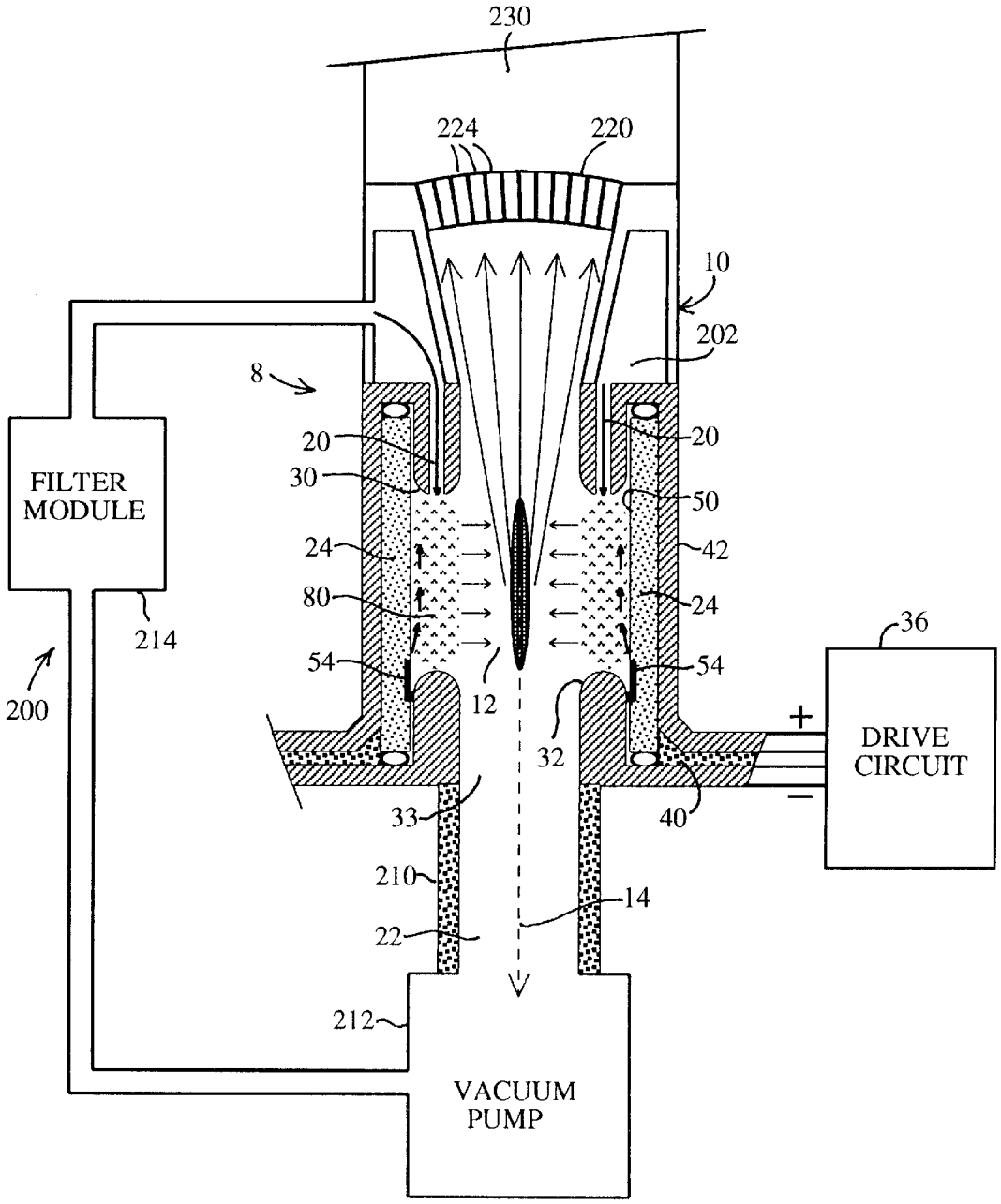
FIG. 6 is a block diagram of a plasma X-ray system in accordance with an embodiment of the invention.

A cross-sectional view of a plasma X-ray source 8 in accordance with a first embodiment of the present invention is shown in FIG. 1. An embodiment of a plasma X-ray system incorporating the plasma X-ray source 8 of FIG. 1 is shown in FIG. 6. Like elements in FIGS. 1 and 6 have the same reference numerals. An enclosed chamber 10 defines a pinch region 12 having a central axis 14. Gas inlets 20 and a gas outlet 22 permit a working gas at a prescribed pressure to be introduced into the pinch region 12. The embodiment of FIGS. 1 and 6 has a generally cylindrical pinch region 12.

A cylindrical insulating wall 24 surrounds pinch region 12. The insulating wall 24 is preferably a high dielectric material, as described below. A pinch anode 30 is disposed at one end of pinch region 12, and a pinch cathode 32 is disposed at the opposite end of pinch region 12. The portion of pinch anode 30 adjacent to pinch region 12 has an annular configuration inside insulating wall 24. Similarly, the portion of pinch cathode 32 adjacent to pinch region 12 has an annular configuration inside insulating wall 24 and spaced from insulating wall 24. Preferably, the pinch anode 30 has an axial hole 31 and the pinch cathode 32 has an axial hole 33 to prevent vaporization by the collapsed plasma and to provide a path for emission of radiation from the X-ray source.

The anode 30 and the cathode 32 are connected to an electrical drive circuit 36 and are separated by an insulator 40. The anode 30 is connected through a cylindrical conductive shell 42 to the drive circuit 36. The conductive shell 42 surrounds insulating wall 24 and pinch region 12. As described below, a high current pulse through conductive shell 42 contributes to an azimuthal magnetic field in pinch region 12. An elastomer ring 44 is positioned between anode 30 and one end of insulating shell 24, and an elastomer ring 46 is positioned between cathode 32 and the other end of insulating wall 24 to ensure that chamber 10 is sealed vacuum tight.

Insulating wall 24 is preferably a ceramic high dielectric material. Insulating wall 24 should have a high melting point and a low vapor pressure. Examples of suitable dielectric materials include but are not limited to the oxide ceramics and the high dielectric constant titanates. In one example, insulating wall 24 comprises alumina having a wall thickness of 3 millimeters and a diameter of 30 millimeters.

In accordance with a feature of the invention, the gas in pinch region 12 is preionized by a surface discharge on an inside surface 50 of insulating wall 24. The surface discharge is produced by an electrode configuration including a first conductor which defines an edge in close proximity to or contacting the inside surface 50 of insulating wall 24 and a second conductor disposed around the outside surface of insulating wall 24. In the embodiment of FIGS. 1 and 6, the first conductor comprises a cathode extension 54 having an edge 56, and the second conductor comprises the conductive shell 42 that surrounds insulating wall 24. The cathode extension 54 is connected to cathode 32. Upon application of a voltage between cathode extension 54 and conductive shell 42, a surface discharge is produced on the inside surface 50 of insulating wall 24, as described below.

Figure 2A:
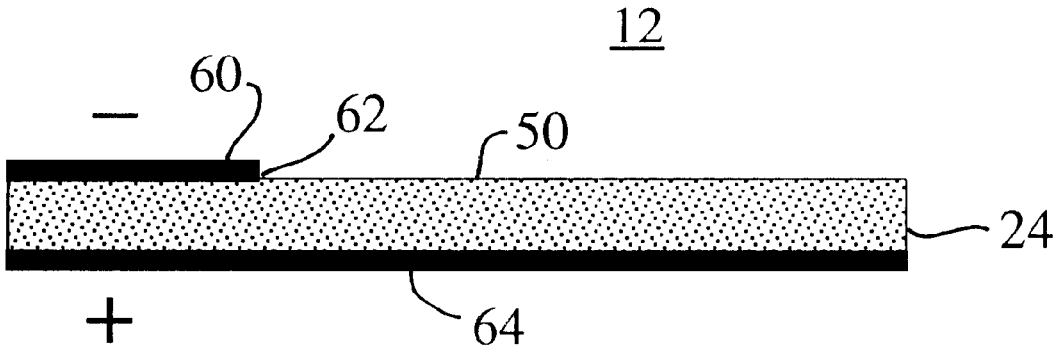
FIGS. 2A and 2B are enlarged partial cross-sectional views of the insulating wall, illustrating the initiation of a surface discharge on the inside surface of the insulating wall.
Figure 2B:
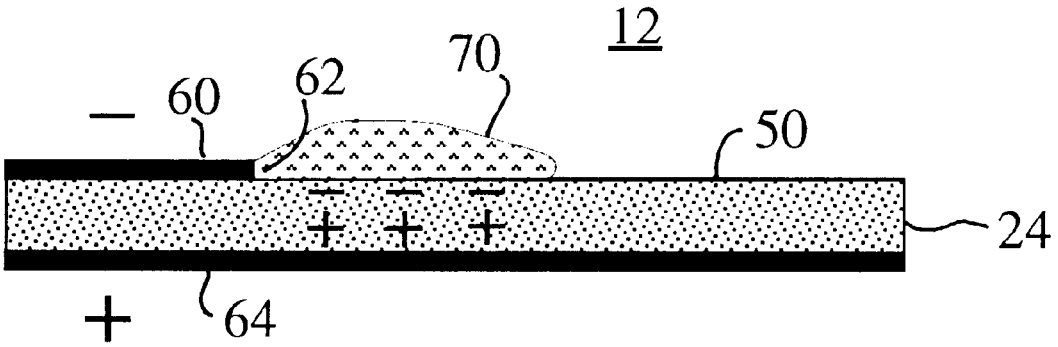

A configuration for producing a surface discharge is illustrated in FIGS. 2A and 2B. A first conductor 60 defines an edge 62 that is in close proximity to or in physical contact with the inside surface 50 of insulating wall 24. Preferably, edge 62 of first conductor 60 is within about 0.005 inch of the inside surface 50 of insulating wall 24. Edge 62 is preferably located at or near one end of pinch region 12 and preferably has an annular shape that is symmetrical with respect to axis 14. This shape promotes formation of a uniform surface discharge on inside surface 50. A second conductor 64 is disposed on the outside surface of insulating wall 24.

In operation, a low pressure working gas or gas mixture is present within pinch region 12. As used herein, low pressure typically refers to pressures in a range of about 0.01 to 1.0 torr. A rapidly rising voltage is applied between first electrode 60 and second electrode 64, with first electrode 60 being negative relative to second electrode 64. The applied voltage initiates an edge-plane, dielectric-assisted surface discharge in which the edge is represented by edge 62 of first electrode 60, the dielectric comprises insulating wall 24 and the plane comprises second conductor 64, which in this embodiment is cylindrical rather than planar. Electrons are emitted at the point where edge 62 terminates on the inside surface 50 of insulating wall 24. These electrons stimulate the desorption of gas atoms from the dielectric surface and ionize many of them, creating a surface discharge 70. Energy is fed into the surface discharge 70 by the current which flows through first conductor 60 to change the electric displacement in insulating wall 24. The discharge emits copious amounts of ultraviolet radiation which assists in the desorption of gas from the opposing interior surface of insulating wall 24, tending to create an azimuthally uniform surface discharge within insulating wall 24, thereby allowing subsequent passage of a high current pulse from drive circuit 36.

In the embodiment of FIGS. 1 and 6, the first conductor 60 comprises cathode extension 54, which is electrically connected to cathode 32, and the second conductor 64 comprises conductive shell 42, which is electrically connected to anode 30. Thus, the high energy electrical pulse supplied by drive circuit 36 is used to form a surface discharge.

Referring again to FIGS. 1 and 6, the operation of the X-ray source subsequent to formation of the surface discharge is as follows. The surface discharge expands into a more diffuse cylindrical plasma shell 80, which is accelerated toward axis 14 by the azimuthal magnetic field generated between the current in plasma shell 80 and the return current in conductive shell 42. At the axis 14, the plasma collides with incoming material from the opposing radial direction to form a linear plasma 84, and its kinetic energy is converted into heat. The working gas is multiply ionized within linear plasma 12 and radiates on transitions in the soft X-ray or extreme ultraviolet spectral region. The radiation leaves the pinch region 12 through hole 31 in anode 30 and hole 33 in cathode 32.

The soft X-ray spectral region is in a range of about 20 eV to 2 keV, and the extreme ultraviolet spectral region is in a range of about 20 eV to 200 eV. Although the devices disclosed herein are termed "X-ray sources" and "X-ray systems", it will be understood that these devices may be configured for generating X-rays or extreme ultraviolet radiation.

By way of example, the embodiment of FIGS. 1 and 6 has been used to generate extreme ultraviolet radiation in the xenon band between 100 angstroms and 150 angstroms (124 eV to 82 eV). Xenon, at a pressure of approximately 50 millitorr, was flowed steadily through pinch region 12. A repetitively pulsed discharge was initiated at a frequency of 100 Hz between anode 30 and cathode 32. The applied voltage from drive circuit 36 had a peak value of 24 kilovolts and a risetime of 50 nanoseconds. The peak current through the discharge was 50 kiloamperes, reached after a delay of 100 nanoseconds, and the pulse duration was 200 nanoseconds. A compact axial plasma was formed on each pulse. Measurements showed that the axial plasma radiated in the axial direction within the xenon band at an intensity of 1 J per steradian on each pulse, equivalent to a power of 100 watts per steradian at 100 Hz. The operation at 100 Hz was continued for more than 1 million pulses.

Figure 3:
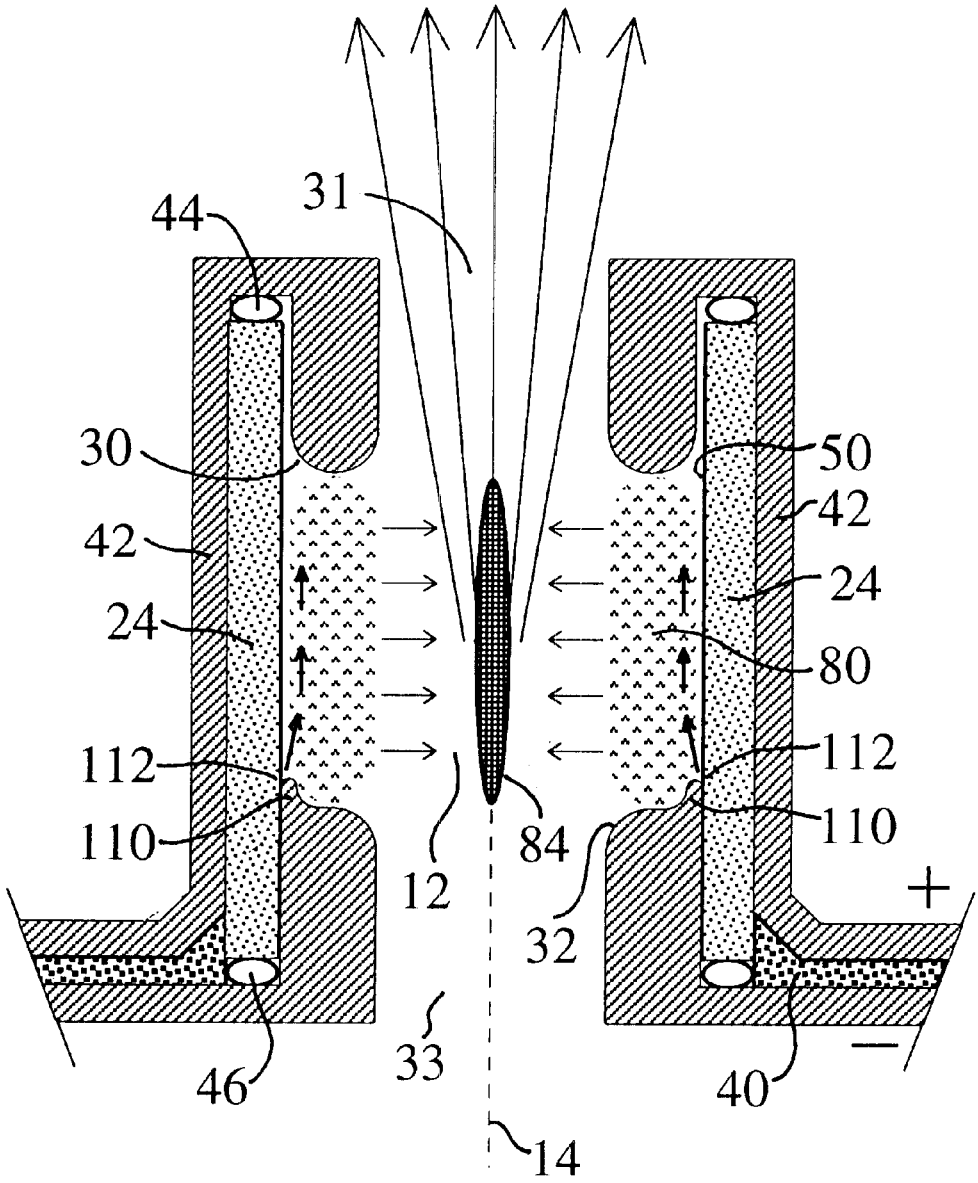
FIG. 3 is a cross-sectional view of a plasma X-ray source in accordance with a second embodiment of the invention.

A cross-sectional view of a plasma x-ray source in accordance with a second embodiment of the invention is shown in FIG. 3. Like elements in FIGS. 1 and 3 have the same reference numerals. In the embodiment of FIG. 3, a separate cathode extension, as shown in FIG. 1, is not utilized. Instead, cathode 32 includes a tapered portion 110 which defines an edge 112 adjacent to the inside surface 50 of insulating wall 24. Tapered portion 110 may be an integral part of cathode 32 and may be tapered toward inside surface 50 of insulating wall 24. Tapered portion 110 terminates in edge 112 having a small radius that is in close proximity to or in physical contact with inside surface 50. In one embodiment, edge 112 has a radius of about 0.5 millimeter. Preferably, tapered portion 110 has an annular shape that is symmetric with respect to axis 14 and is located at or near one end of pinch region 12. In the embodiment of FIG. 3, tapered portion 110 of cathode 32 corresponds to first conductor 60 shown in FIGS. 2A and 2B, and conductive shell 42 corresponds to second conductor 64 shown in FIGS. 2A and 2B.

A surface discharge is initiated where edge 112 meets the inside surface 50 of insulating wall 24, because high electric fields at this point release electrons from the cathode 32 by field emission. The surface discharge propagates because of the capacitance between the growing plasma shell and the voltage on conductive shell 42 outside insulating wall 24.

Figure 4:
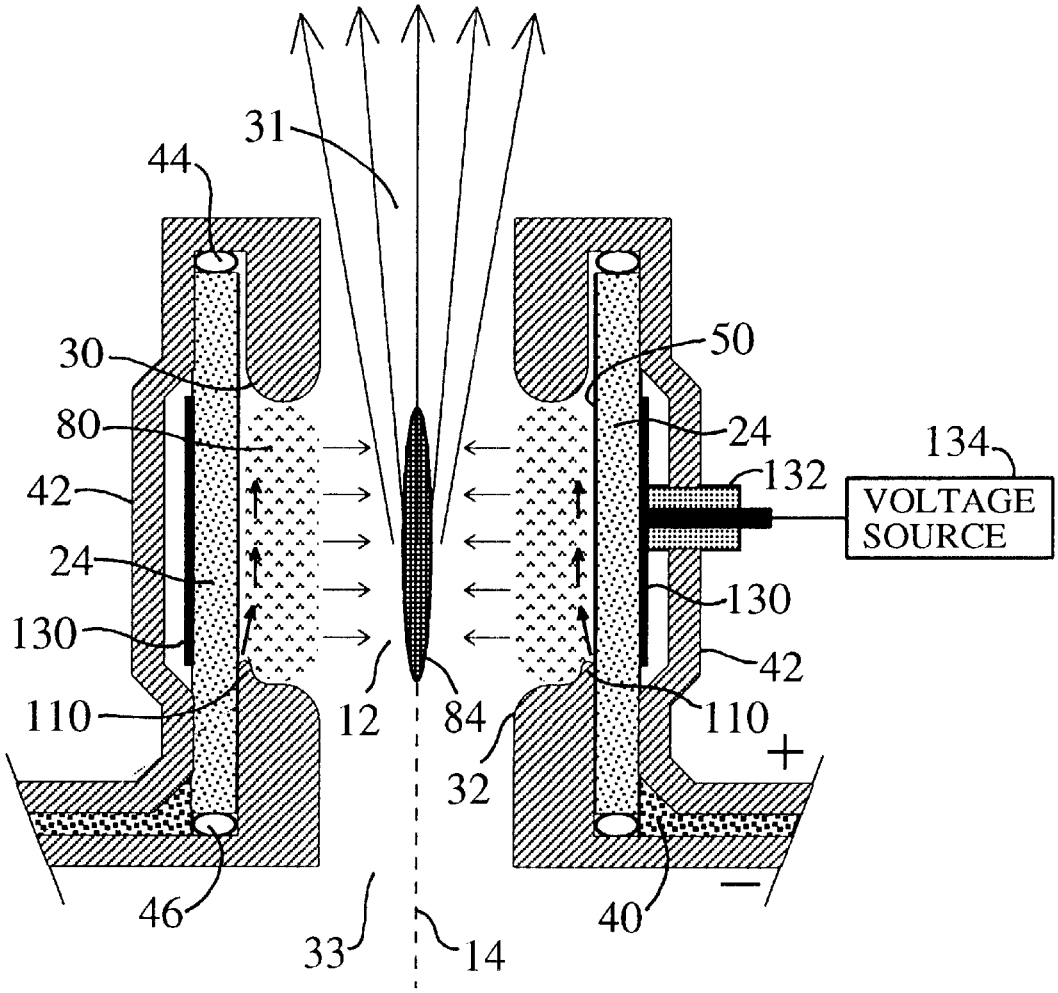
FIG. 4 is a cross-sectional view of a plasma X-ray source in accordance with a third embodiment of the invention.

A cross-sectional view of a plasma X-ray source in accordance with a third embodiment of the invention is shown in FIG. 4. Like elements in FIGS. 1–4 have the same reference numerals. In the embodiment of FIG. 4, a preionizer control electrode 130 surrounds the outside surface of insulating wall 24. In one example, preionizer control electrode 130 has a cylindrical shape with an axial length that corresponds to the axial length of pinch region 12 between anode 30 and cathode 32. Conductive shell 42 surrounds preionizer control electrode 130 and insulating wall 24, but is spaced from and does not electrically contact preionizer control electrode 130. Preionizer control electrode 130 is connected through an insulated bushing 132 to a preionizer voltage source 134. Cathode 32 is provided with tapered portion 110 as described above in connection with FIG. 3. Thus, in the embodiment of FIG. 4, tapered portion 110 of cathode 32 corresponds to first conductor 60 shown in FIGS. 2A and 2B, and preionizer control electrode 130 corresponds to second conductor 64 shown in FIGS. 2A and 2B.

The embodiment of FIG. 4 permits the surface discharge preionization to be controlled independently of the main discharge pulse from drive circuit 36 (FIG. 6). For example, the embodiment of FIG. 4 permits the timing of the surface discharge initiation to be varied relative to the main discharge pulse. In addition, the amplitude, waveform and other parameters of the preionizer voltage produced by voltage source 134 can be selected to produce a desired surface discharge, in contrast to the embodiments of FIGS. 1 and 2 where the preionizer voltage is established by drive circuit 36 and cannot be varied independently. As an example of the operation of the plasma X-ray source shown in FIG. 4, preionization can be initiated a predetermined time before the application of the main high energy pulse, for example between 100 nanoseconds and 1 microsecond in advance, by the appropriately timed application of a rapidly rising positive voltage pulse on prelonizer control electrode 130, while the pinch anode 30 and the pinch cathode 32 are held at ground potential. The effect with respect to formation of the surface discharge is the same as described above in connection with FIGS. 1 and 3, where a negative pulse is applied to the cathode 32 relative to the conductive shell 42. A surface discharge is initiated, and the surface discharge spreads from the edge 112 of cathode 32 or annular conductor 60 along the inside surface 50 of insulating wall 24. In contrast to the previous cases, where the surface discharge grew at a rate determined by the rate of application of the main discharge voltage and had an amplitude determined by that voltage, the surface discharge initiated by a preionization voltage on control electrode 130 can be weaker, with proportionally less surface erosion of insulating wall 24. Also, with advanced timing there is more time for the surface discharge to develop in multiple locations on inside surface 50 and to become more uniform prior to the application of the main discharge pulse. Uniformity of preionization enhances the stability of the Z-pinch discharge and therefore improves the reproducibility of the output of the source.

Figure 7:
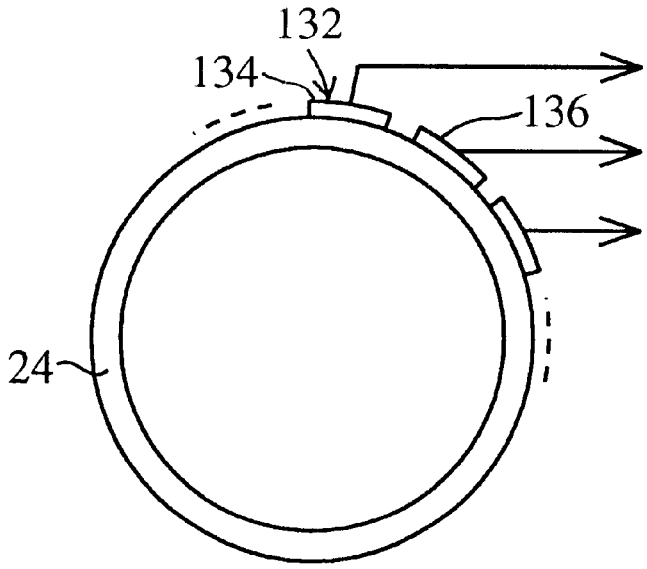
FIG. 7 is an axial view of an example of a preionizing control electrode having multiple elements.

The preionizer control electrode can have many different configurations. As shown in FIG. 4 and described above, electrode 130 can be a cylindrical shell. In another configuration shown in FIG. 7, a preionizer control electrode 132 includes multiple electrode elements 134, 136, etc., which substantially cover the outer surface of insulating wall 24 and which each have a separate voltage feed. This configuration allows programming of the intensity and timing of the surface discharge at different locations around insulating wall 24. One reason for having this flexibility is to ensure that many independent surface discharges are initiated with equal intensity at different locations around insulating wall 24, thereby ensuring a uniform main discharge and reproducible radiation from the source.

Figure 8:
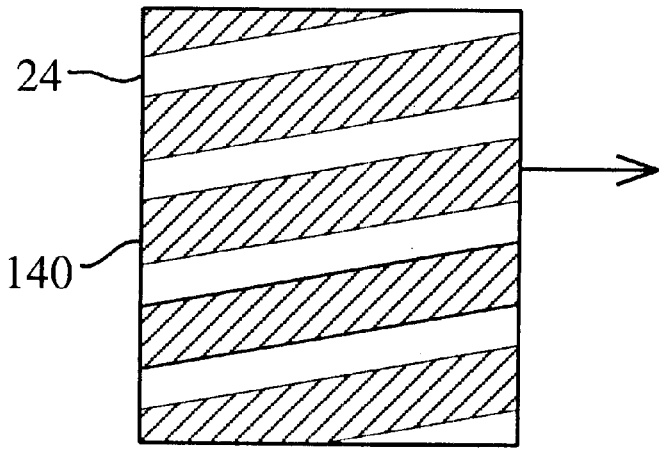
FIG. 8 is a side view of an example of a helical preionizing control electrode.

In another configuration shown in FIG. 8, a preionizer control electrode comprises a helical strip 140 on the outside surface of insulating wall 24. An alternating voltage applied to the helical strip 140 through a single voltage feed initiates the surface discharge. In this configuration, voltage source 134 can be a radio frequency generator which performs the dual function of initiating a surface discharge and spreading the surface discharge via an oscillating acceleration of electrons., which improves the azimuthal uniformity of the surface discharge. In one example, preionizer voltage source 134 was a radio frequency generator operating at a frequency of 1 GHz and an output voltage of 4 kilovolts.

Figure 5:
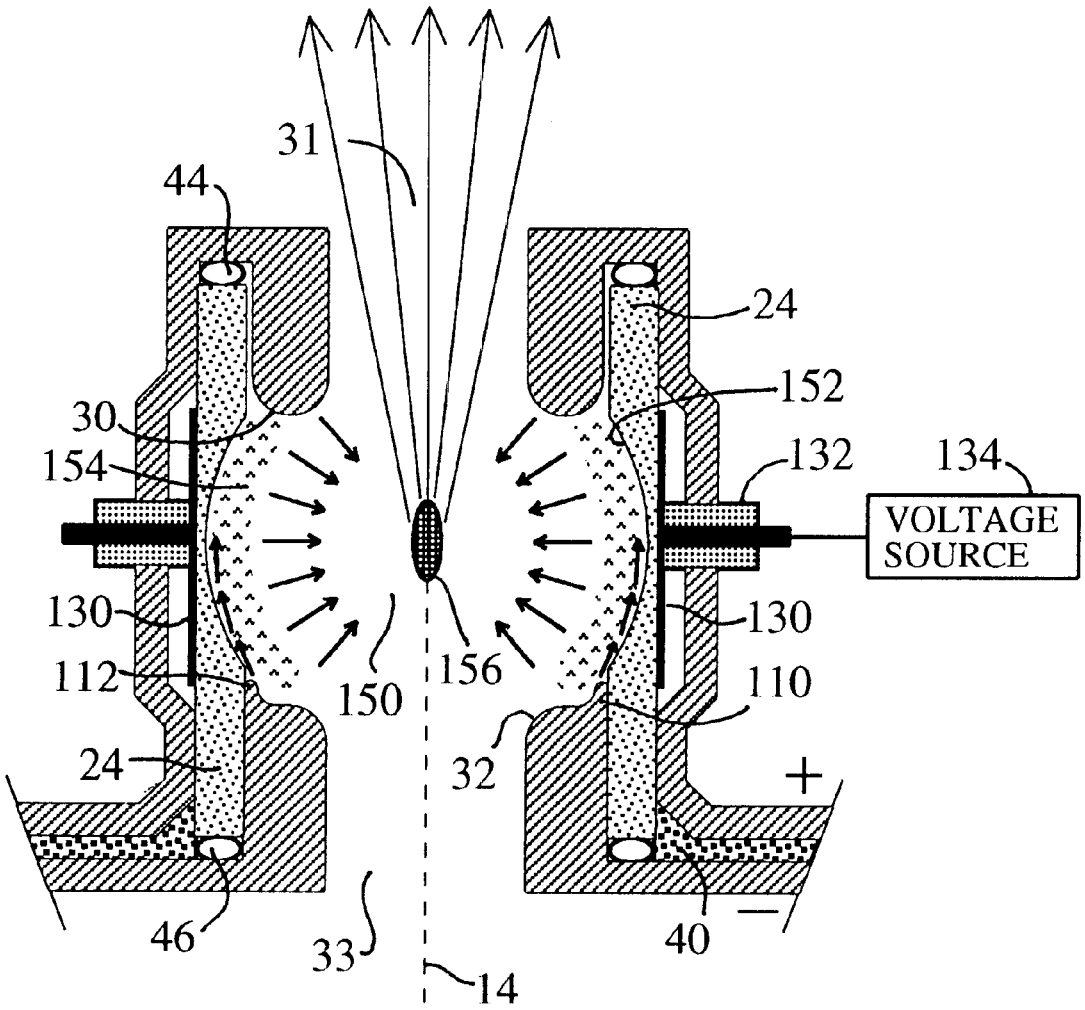
FIG. 5 is a cross-sectional view of a plasma X-ray source in accordance with a fourth embodiment of the invention.

A cross-sectional view of a plasma X-ray source in accordance with a fourth embodiment of the invention is shown in FIG. 5. Corresponding elements in FIGS. 1–5 have the same reference numerals. In the embodiment of FIG. 5, an approximately spherical pinch region 150 is defined between an arc-shaped inside surface 152 of insulating wall 24, pinch anode 30 and pinch cathode 32. It will be understood that pinch region 150 is not a complete sphere, but is defined by rotation of the arc-shaped surface 152 of insulating wall 24 about axis 14. As a result, a plasma shell 154 has a spherical configuration and collapses toward a point 156 on axis 14.

The plasma X-ray source shown in FIG. 5 includes tapered portion 110 of cathode 32 and preionizer control electrode 130. Preionizer control electrode 130 is coupled through insulated bushing 132 to preionizer voltage source 134. These elements produce a surface discharge on the arc-shaped inside surface 152 of insulating wall 24 when voltage source 134 is energized. The surface discharge in turn causes formation of spherical plasma shell 154, which collapses toward point 156 when the main electrical pulse from drive circuit 36 (FIG. 6) is applied to the plasma X-ray source.

The plasma X-ray system shown in FIG. 6 includes plasma X-ray source 8, as shown in FIG. 1 and described above. It will be understood that the plasma X-ray source 8 of FIG. 1 can be replaced by the embodiments shown in FIGS. 3–5 and described above, with the addition of preionizer voltage source 134 in the embodiments of FIGS. 4 and 5.

A working gas from a gas supply system 200 may be introduced into pinch region 12 through gas inlets 20 in anode 30. The gas is distributed around anode 30 in a manifold 202. Most of the exhaust gas from pinch region 12 passes through hole 33 in cathode 32 and through gas outlet 22, defined by an insulating conduit 210, to a vacuum pump 212. The working gas is filtered and purified in a filter module 214 before reentry at a controlled rate into manifold 202. The gas supply system 200 includes vacuum pump 212, filter module 214 and the interconnecting conduits for circulating the working gas through pinch region 12.

A barrier plate 220 is positioned in the path of the radiation beam along axis 14 in order to retain as much of the working gas as possible within the recirculation loop including pinch region 12, vacuum pump 212 and filter module 214. Barrier plate 220 may include a multiplicity of holes 224. Gas flow through the holes is minimized by the choice of hole diameter, but the holes are aligned with the radiation beam so as to transmit as much as possible of the beam into region 230, which is a more highly evacuated region that connects with the point of use of the radiation. As an example, holes of diameter 0.06 inch and length 0.3 inch are close packed in a hexagonal array to yield a geometrical transmission of 60% for extreme ultraviolet or soft X-ray radiation, while greatly reducing the gas flow that would otherwise occur from the source into the user region.

Although any gas or combination of gases may be used within the scope of the invention to generate any soft X-ray or extreme ultraviolet photon spectrum, two gases are known to be of particular interest for the generation of 13.5 nanometer extreme ultraviolet radiation, which is useable for extreme ultraviolet lithography because of the highly reflecting molybdenum-silicon multilayer mirrors that reflect best at that wavelength. Xenon gas generates strong emission bands between 10 nanometers and 15 nanometers, and lithium generates a spectral line at 13.5 nanometers. Lithium may be circulated through pinch region 12 with a carrier gas, such as argon. The gas pressure in pinch region 12 is typically in a range of about 0.01 to 1.0 torr.

Drive circuit 36 is connected between pinch anode 30 and pinch cathode 32. The drive circuit 36 may comprise multiple circuits connected in parallel to the pinch anode 30 and the pinch cathode 32 to achieve the required current level. Additional information concerning the drive circuit is disclosed in the aforementioned U.S. Pat. No. 5,504,795, which is hereby incorporated by reference. In one embodiment, the drive circuit 36 may comprise a solid state switched pulse generator with magnetic pulse compression, as known in the art.

As described above, one of the plasma X-ray sources shown in FIGS. 1 and 3–5 may be utilized in the plasma X-ray system of FIG. 6. The X-ray sources may be configured for easy replacement in the plasma X-ray system. Thus, the plasma X-ray source may be replaced when the electrodes and/or the insulating wall show signs of wear, or for any other reason.

It will be understood that the embodiments of the first and second conductors for producing a surface discharge on the inside surface of the insulating wall, as shown and described above, may be used in various combinations within the scope of the invention. For example, the cathode extension 54 shown in FIGS. 1 and 6 may be used with the preionizer control electrodes shown in FIGS. 4, 7 and 8. In addition, different embodiments of the first and second conductors may be used in the cylindrical geometry of FIGS. 1, 3 and 4 or the spherical geometry of FIG. 5. Furthermore, other embodiments of the first and second conductors may be used within the scope of the invention for producing a surface discharge as shown in FIGS. 2A and 2B and described above.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A Z-pinch plasma X-ray source comprising:

a chamber containing a gas at a prescribed pressure, said chamber comprising an insulating wall and defining a pinch region having a central axis, said insulating wall having an inside surface and an outside surface;

a pinch anode disposed at one end of said pinch region;

a conductive shell surrounding said insulating wall and electrically connected to said pinch anode;

a pinch cathode disposed at an opposite end of said pinch region;

a first conductor defining an edge in close proximity to or contacting the inside surface of said insulating wall; and a second conductor disposed around the outside surface of said insulating wall, wherein a surface discharge is produced on the inside surface of said insulating wall in response to application of a voltage to said first and second conductors, said surface discharge causing the gas to ionize and to form a plasma shell near the inside surface of said insulating wall, wherein said pinch anode and said pinch cathode produce a current through the plasma shell in an axial direction and produce an azimuthal magnetic field in said pinch region in response to application of a high energy electrical pulse to said pinch anode and said pinch cathode, whereby said azimuthal magnetic field causes said plasma shell to collapse to said central axis and to generate X-rays.

2. A Z-pinch plasma X-ray source as defined in claim 1 wherein said second conductor comprises said conductive shell.

3. A Z-pinch plasma X-ray source as defined in claim 1 wherein said second conductor comprises a preionizer control electrode positioned between said conductive shell and said insulating wall, said preionizer control electrode being coupled to a preionizer voltage source.

4. A Z-pinch plasma X-ray source as defined in claim 3 wherein said preionizer voltage source comprises a radio frequency source.

5. A Z-pinch plasma X-ray source as defined in claim 1 wherein said first conductor comprises said cathode and wherein said cathode is tapered toward said insulating wall to define said edge.

6. A Z-pinch plasma X-ray source as defined in claim 1 wherein said first conductor comprises a cathode extension coupled between said cathode and said insulating wall.

7. A Z-pinch plasma X-ray source as defined in claim 1 wherein said first conductor has an annular configuration.

8. A Z-pinch plasma X-ray source as defined in claim 5 wherein said cathode is in physical contact with said insulating wall.

9. A Z-pinch plasma X-ray source as defined in claim 5 wherein said cathode is in close proximity to said insulating wall.

10. A Z-pinch plasma X-ray source as defined in claim 1 wherein the inside surface of said insulating wall is at least in part cylindrical.

11. A Z-pinch plasma X-ray source as defined in claim 1 wherein the inside surface of said insulating wall is at least in part spherical.

12. A Z-pinch plasma X-ray source as defined in claim 3 wherein said preionizer control electrode comprises a cylindrical electrode located on the outside surface of said insulating wall.

13. A Z-pinch plasma X-ray source as defined in claim 3 wherein said preionizer control electrode comprises a plurality of electrode elements having separate voltages applied thereto.

14. A Z-pinch plasma X-ray source as defined in claim 3 wherein said preionizer control electrode comprises a helical electrode.

15. A Z-pinch plasma X-ray source as defined in claim 3 further comprising means for applying a preionizer voltage to said preionizer control electrode prior to application of said high energy electrical pulse to said pinch anode and said pinch cathode.

16. A Z-pinch plasma X-ray source as defined in claim 1 wherein said high energy electrical pulse is generated by a solid state switched pulse generator with magnetic pulse compression.

17. A Z-pinch plasma X-ray source as defined in claim 1 wherein said gas comprises xenon for the generation of extreme ultraviolet radiation in a band between 100 Angstroms and 150 Angstroms.

18. A Z-pinch plasma X-ray source as defined in claim 1 wherein said gas comprises lithium for the generation of the doubly ionized lithium resonance line at 135 Angstroms.

19. A Z-pinch plasma X-ray source as defined in claim 18 wherein a carrier gas is used to deliver and remove lithium vapor.

20. A Z-pinch plasma X-ray source as defined in claim 19 wherein the carrier gas comprises argon.

21. A Z-pinch plasma X-ray system comprising:

a chamber comprising an insulating wall and defining a pinch region having a central axis, said insulating wall having an inside surface and an outside surface;

a pinch anode disposed at one end of said pinch region;

a conductive shell surrounding said insulating wall and electrically connected to said pinch anode;

a pinch cathode disposed at an opposite end of said pinch region;

a gas supply system coupled to said chamber;

a first conductor defining an edge in close proximity to or contacting the inside surface of said insulating wall;

a second conductor disposed around the outside surface of said insulating wall, wherein a surface discharge is produced on the inside surface of said insulating wall in response to application of a voltage to said first and second conductors, said surface discharge causing the gas to ionize and to form a plasma shell near the inside surface of said insulating wall; and a drive circuit connected to said pinch anode and said pinch cathode for applying a high energy electrical pulse to said pinch anode and said pinch cathode, said high energy electrical pulse producing a current through the plasma shell in an axial direction and producing an azimuthal magnetic field in said pinch region, whereby said azimuthal magnetic field causes said plasma shell to collapse to said central axis and to generate X-rays.

22. A Z-pinch plasma X-ray system as defined in claim 21 wherein said gas supply system comprises a vacuum pump coupled to said pinch region for recompression of exhaust gas pumped from said pinch region and for recirculating the gas to said pinch region.

23. A Z-pinch plasma X-ray system as defined in claim 22 wherein said gas supply system further comprises a filter module for filtration and purification of the gas exhausted from said pinch region prior to its return to the pinch region.

24. A Z-pinch plasma X-ray system as defined in claim 21 further comprising a barrier plate located on said axis outside said pinch region, said barrier plate having a multiplicity of aligned holes for passing soft X-rays or extreme ultraviolet radiation while impeding the flow of gas from the pinch region.

25. A Z-pinch plasma X-ray system as defined in claim 21 wherein said second conductor comprises said conductive shell.

26. A Z-pinch plasma X-ray system as defined in claim 21 wherein said second conductor comprises a preionizer control electrode positioned between said conductive shell and said insulating wall, said preionizer control electrode being coupled to a preionizer voltage source.

27. A Z-pinch plasma X-ray system as defined in claim 26 wherein said preionizer voltage source comprises a radio frequency power source.

28. A Z-pinch plasma X-ray system as defined in claim 21 wherein said first conductor comprises said cathode and wherein said cathode is tapered toward said insulating wall to define said edge.

29. A Z-pinch plasma X-ray system as defined in claim 21 wherein said first conductor comprises a cathode extension coupled between said cathode and said insulating wall.

30. A Z-pinch plasma X-ray system as defined in claim 21 wherein the edge of said first conductor has an annular configuration and is located at or near one end of said pinch region.

31. A Z-pinch plasma X-ray system as defined in claim 21 wherein the inside surface of said insulating wall is at least in part cylindrical.

32. A Z-pinch plasma X-ray system as defined in claim 21 wherein the inside surface of said insulating wall is at least in part spherical.

33. A Z-pinch plasma X-ray system as defined in claim 26 wherein said preionizer control electrode comprises a cylindrical electrode and is located on the outside surface of said insulating wall.

34. A Z-pinch plasma X-ray system as defined in claim 26 wherein said prelonizer control electrode comprises a plurality of electrode elements having separate voltages applied thereto.

35. A Z-pinch plasma X-ray system as defined in claim 26 wherein said preionizer control electrode comprises a helical electrode.

36. A Z-pinch plasma X-ray system as defined in claim 26 further comprising means for applying a preionizer voltage to said preionizer control electrode prior to application of said high energy electrical pulse to said pinch anode and said pinch cathode.

37. A method for generating soft X-rays or extreme ultraviolet radiation in a Z-pinch plasma X-ray source comprising a Z-pinch chamber containing a gas at a prescribed pressure, said chamber comprising an insulating wall and defining a pinch region having a central axis, a pinch anode disposed at one end of said pinch region and a pinch cathode disposed at an opposite end of said pinch region, said method comprising the steps of:

producing, on an inside surface of said insulating wall, a surface discharge that causes the gas to ionize and to form a plasma shell near said insulating wall; and applying a high energy electrical pulse to said pinch anode and said pinch cathode to produce a current through the plasma shell in an axial direction and to produce an azimuthal magnetic field in said pinch region, whereby said azimuthal magnetic field causes said plasma shell to collapse to said central axis and to generate X-rays.

38. A method as defined in claim 37 wherein the step of producing a surface discharge comprises the steps of providing a first conductor defining an edge in close proximity to or contacting the inside surface of said insulating wall, providing a second conductor on the outside surface of said insulating wall and applying a voltage to said first and second conductors, wherein the surface discharge is produced on the inside surface of said insulating wall.

39. A method as defined in claim 38 wherein the step of applying a voltage to said first and second conductors comprises applying said high energy electrical pulse to said first and second conductors.

40. A method as defined in claim 38 wherein the step of providing a second conductor comprises providing a preionizer control electrode positioned on the outside surface of said insulating wall and wherein the step of applying a voltage to said first and second conductors comprises applying a preionizer voltage to said preionizer control electrode.

41. A method as defined in claim 40 wherein the step of applying a preionizer voltage to said preionizer control electrode comprises applying the preionizer voltage to said preionizer control electrode prior to the application of said high energy electrical pulse to said pinch anode and said pinch cathode.

42. A Z-pinch plasma X-ray source comprising:

a chamber containing a gas at a prescribed pressure, said chamber comprising an insulating wall and defining a pinch region having a central axis, said insulating wall having an inside surface and an outside surface;

a pinch anode and a pinch cathode disposed at opposite ends of said pinch region;

a conductive shell surrounding said insulating wall and electrically connected to said pinch anode;

means for producing a surface discharge on the inside surface of said insulating wall, said surface discharge causing the gas to ionize and to form a plasma shell near the inside surface of said insulating wall, wherein said pinch anode and said pinch cathode produce a current through the plasma shell in an axial direction and produce an azimuthal magnetic field in said pinch region in response to application of a high energy electrical pulse to said pinch anode and said pinch cathode, whereby said azimuthal magnetic field causes said plasma shell to collapse to said central axis and to generate X-rays.

* * * * *